US011206490B2

(12) United States Patent
Kim et al.

(10) Patent No.: US 11,206,490 B2
(45) Date of Patent: Dec. 21, 2021

(54) SOUND GENERATING ACTUATOR

(71) Applicant: EM-TECH Co., Ltd., Gyeongsangnam-do (KR)

(72) Inventors: Cheon Myeong Kim, Gyeongsangnam-do (KR); Jae Hwa Lim, Gyeongsangnam-do (KR); Jeong Ae Ha, Gyeongsangnam-do (KR); Ji Young Lee, Gyeongsangnam-do (KR); Byung Ho Jung, Gyeongsangnam-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 16/892,405

(22) Filed: Jun. 4, 2020

(65) Prior Publication Data

US 2020/0389737 A1 Dec. 10, 2020

(30) Foreign Application Priority Data

Jun. 5, 2019 (KR) ..... 10-2019-0066736

(51) Int. Cl.
*H04R 9/02* (2006.01)
*H04R 9/04* (2006.01)
(Continued)

(52) U.S. Cl.
CPC ..... *H04R 9/022* (2013.01); *H04R 7/04* (2013.01); *H04R 9/025* (2013.01); *H04R 9/043* (2013.01);
(Continued)

(58) Field of Classification Search
CPC . H04R 7/04; H04R 7/045; H04R 7/20; H04R 9/022; H04R 9/025; H04R 9/043;
(Continued)

(56) References Cited

U.S. PATENT DOCUMENTS 6,373,957 B1 * 4/2002 Stewart ..... H04R 9/022 381/397
6,618,487 B1 * 9/2003 Azima ..... H04R 1/24 381/152
(Continued)

FOREIGN PATENT DOCUMENTS

CN 1463207 A 12/2003
CN 1463565 A 12/2003
(Continued)

OTHER PUBLICATIONS

Rui, Wang, et al., "Study on the Sound Radiation Characteristics of Panel Loudspeaker", Transactions of Beijing Institute of Technology, May 31, 2007, pp. 1-10. (English Abstract).
(Continued)

*Primary Examiner* — Huyen D Le
(74) *Attorney, Agent, or Firm* — Murphy, Bilak & Homiller, PLLC

(57) ABSTRACT

The present invention is intended to provide a sound generating actuator which can facilitate heat dissipation from a voice coil. According to the present invention, there is provided a sound generating actuator, including: a frame; a stationary part mounted on the frame and provided with a yoke, a magnet and a top plate to compose a magnetic circuit; a voice coil configured to receive an electrical signal and vibrate due to a magnetic field and mutual electromagnetic force of the stationary part; a spring configured to dampen vibration of the voice coil and that is made of a metallic material and secured to the frame; and a contact pad that is attached to the spring and configured to transfer vibration of the voice coil.

10 Claims, 11 Drawing Sheets

(51) Int. Cl.
*H04R 7/04* (2006.01)
*H04R 9/06* (2006.01)

(52) U.S. Cl.
CPC ..... *H04R 9/045* (2013.01); *H04R 9/06* (2013.01); *H04R 2440/01* (2013.01); *H04R 2440/05* (2013.01)

(58) Field of Classification Search
CPC ..... H04R 9/045; H04R 9/06; H04R 2440/01; H04R 2440/05; H04R 2440/07
See application file for complete search history.

(56) References Cited

U.S. PATENT DOCUMENTS

| | | | | |
|---|---|---|---|---|
| 2003/0185415 | A1 | 10/2003 | Funahashi et al. | |
| 2003/0227225 | A1 | 12/2003 | Kaneda et al. | |
| 2013/0156237 | A1* | 6/2013 | Kim | H04R 31/00 381/191 |
| 2017/0353800 | A1 | 12/2017 | Lee et al. | |
| 2018/0302724 | A1* | 10/2018 | Li | H04R 7/12 |
| 2019/0104369 | A1* | 4/2019 | Kim | H04R 31/006 |
| 2019/0149908 | A1 | 5/2019 | Kim et al. | |
| 2020/0053469 | A1* | 2/2020 | Hu | H05K 1/181 |

FOREIGN PATENT DOCUMENTS

| | | | |
|---|---|---|---|
| CN | 102598709 | A | 7/2012 |
| CN | 103416043 | A | 11/2013 |
| CN | 107113502 | A | 8/2017 |
| CN | 109782846 | A | 5/2019 |
| JP | H11355887 | A | 12/1999 |
| JP | 2004104327 | A | 4/2004 |
| KR | 20030055812 | A | 7/2003 |
| KR | 20130004464 | A | 1/2013 |
| KR | 20190066736 | A | 6/2019 |
| WO | 2019073401 | A1 | 4/2019 |

OTHER PUBLICATIONS

Yuan, Ming, et al., "Stiffened Panel Sound Radiation Attenuation Using Acceleration Feedback and Internal Model Control", IEEE, 2011, pp. 1-4.

"English Translation of Chinese Office Action of CN Application No. 202010461335.9", China National Intellectual Property Administration, May 8, 2021, pp. 1-14.

* cited by examiner

SOUND GENERATING ACTUATOR

TECHNICAL FIELD

The present invention relates to a sound generating actuator.

BACKGROUND

A flat panel speaker is used in a device such as a mobile phone, a personal digital assistant (PDA) or a personal computer (PC), and it employs, as a diaphragm, a transparent (flat) panel disposed on the surface of the device to cover a display surface of a display device such as a liquid crystal display device.

FIG. 1 shows an example of a conventional flat panel speaker disclosed in Japan Patent Application Publication 2004-104327, wherein a panel 21 equipped with an actuator 10 is disposed on a surface of a mobile phone, with its edges secured to a case 22 of the mobile phone. Here, a gasket 23 is fitted between the edges of the panel 21 and the case 22 on the whole periphery, and the panel 21 is supported on the case 22 through the gasket 23. In FIG. 1, reference numeral 24 denotes a printed circuit board and reference numeral 25 denotes a lead wire for connecting the actuator 10 to the printed circuit board 24. Although not illustrated, a display device, such as a liquid crystal display device, is mounted on the printed circuit board 24.

In the flat panel speaker with the aforementioned configuration, an audio signal is input to the actuator 10, which causes a piezoelectric diaphragm 11 and 12 to vibrate, such vibration is transferred to the panel 21 through a holder 13 in the form of waves, and sound is emitted through the entire panel 21. The gasket 23 fitted between the panel 21 and the case 22 may decrease vibration transferred to the case 22 and increase the amount of vibration of the panel 21.

However, the piezoelectric diaphragm sufficiently generates mid- and high-frequency sound, but does not sufficiently generate low-frequency sound. Moreover, a piezoelectric element can generate a vibration force enough to generate sound, but cannot provide a vibration force strong enough to enable a vibration function.

In order to solve the foregoing problems, a sound vibration actuator has been developed, in which a panel is vibrated through a dynamic actuator using an electromagnetic circuit rather than a piezoelectric element. Furthermore, there is a need for an actuator that generates sound through vibration to realize a bezel-less trend of a mobile device.

However, so as to generate sound using a panel or a frame in place of a diaphragm, an actuator that directly applies vibration is advantageous, in which a vibration part of the actuator is directly adhered to a member, which serves as a diaphragm, to vibrate it with a strong force.

The size or output of the actuator needs to be increased to improve sound performance. But the size of the actuator is limited for use in a mobile device, so the output of the actuator is to be increased. Here, heat generation issues occur when the output of the actuator is increased. As a result, there is a need for an actuator that can address such heat generation issues.

SUMMARY

An object of the present invention is to provide a sound generating actuator which can facilitate heat dissipation from a voice coil.

According to an aspect of the present invention for achieving the above object, there is provided a sound generating actuator, comprising: a frame; a stationary part that is mounted on the frame and provided with a yoke, a magnet and a top plate to compose a magnetic circuit; a voice coil that receives an electrical signal and vibrates due to a magnetic field and mutual electromagnetic force of the stationary part; a spring that damps vibration of the voice coil attached thereto and that is made of a metallic material and secured to the frame; and a contact pad that is attached to the spring and transfers vibration of the voice coil.

In some embodiments, the contact pad may be insert injection molded at the center of the spring.

In some embodiments, the sound generating actuator may include a conductive member having one end attached to the bottom of the voice coil and the other end extended to outside of the frame.

In some embodiments, the conductive member may include a plurality of bendings not to interfere with the movement of the voice coil.

In some embodiments, the yoke may include a protruding portion extended to protrude to the outer surface of the frame.

In some embodiments, the protruding portion may include a fastening hole to which a fastening member can be coupled.

In some embodiments, the sound generating actuator may further include a ring plate made of a metallic material and insert injection molded on the surface of the frame that comes in contact with the spring.

In some embodiments, the corners of the ring plate may be downwardly bent.

In some embodiments, the sound generating actuator may further include a heat dissipation material attached on the bottom of the yoke to aid in dissipating heat.

In some embodiments, the frame may include a protruding portion extended to protrude to outside of the frame.

The sound generating actuator provided by the present invention has an advantage in that the voice coil is attached to the lower end of the spring made of a metallic material, so that heat of the voice coil can be emitted through the spring.

Furthermore, the sound generating actuator provided by the present invention has an advantage in that the ring plate made of a metallic material is insert injection molded into the frame, so that heat of the spring can be emitted through the ring plate.

DETAILED DESCRIPTION

A sound generating actuator according to the present invention will now be described in more detail.

Figure 1:
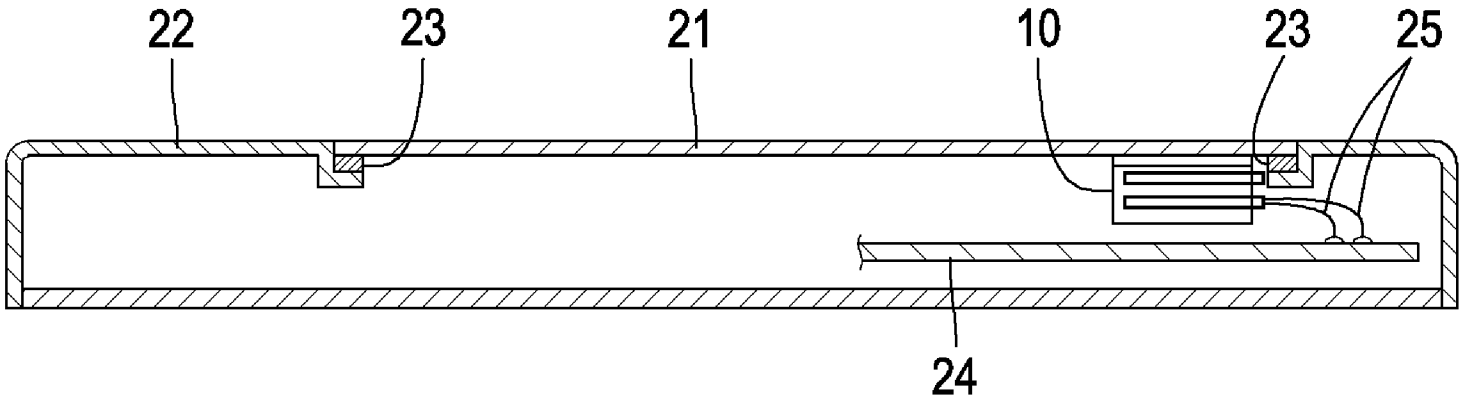
FIG. 1 is a view showing a conventional flat panel speaker.
Figure 2:
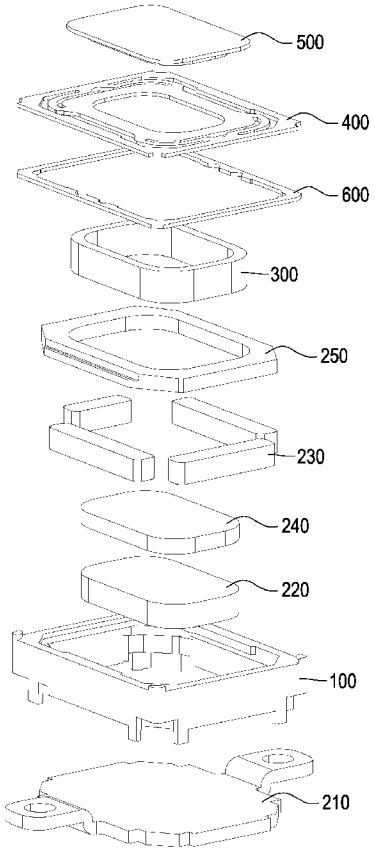
FIG. 2 is an exploded view showing a sound generating actuator according to a first embodiment of the present invention.
Figure 3:
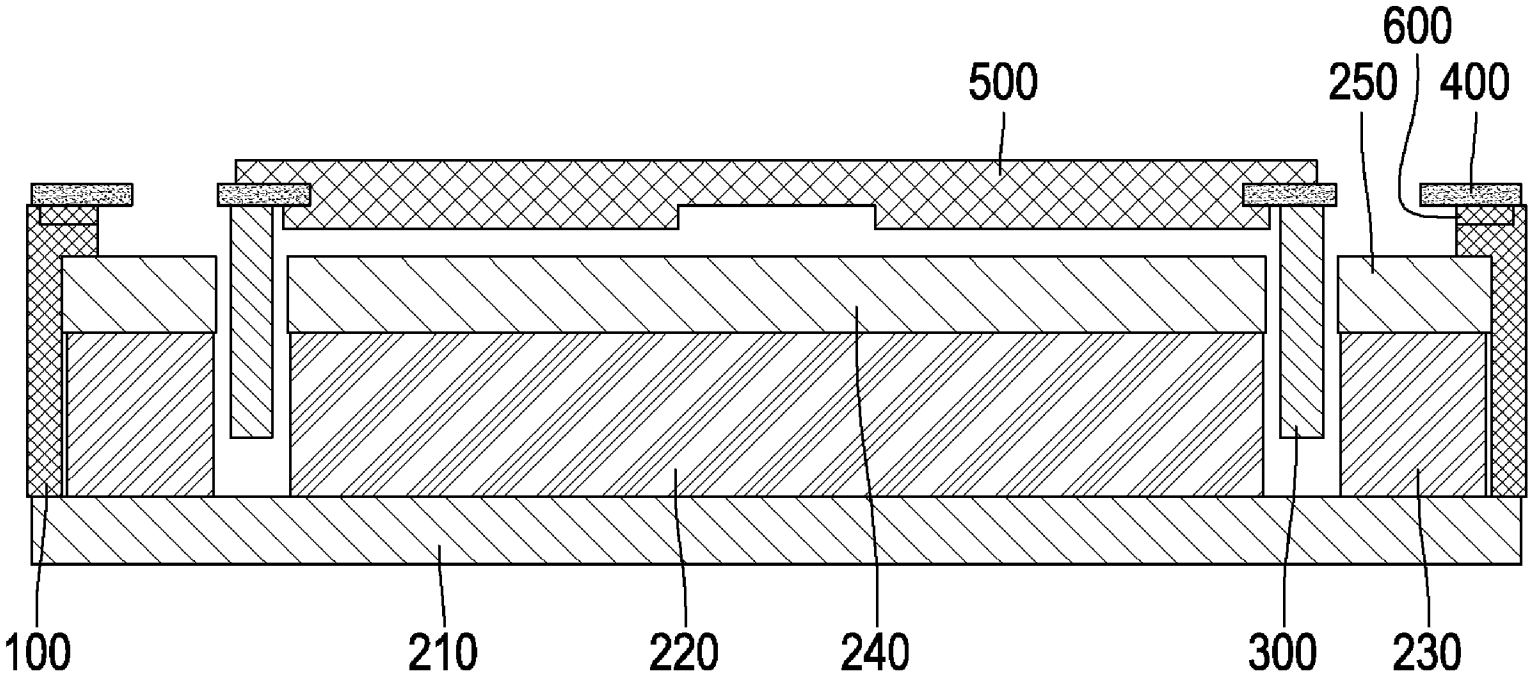
FIG. 3 is a perspective view showing the sound generating actuator according to the first embodiment of the present invention.

FIG. 2 is an exploded view showing a sound generating actuator according to a first embodiment of the present invention and FIG. 3 is a perspective view showing the sound generating actuator according to the first embodiment of the present invention.

The sound generating actuator according to the first embodiment of the present invention includes a frame 100 that forms a side appearance. A yoke 210 is coupled to the bottom of the frame, a center magnet 220 is attached on the yoke 210, side magnets 230 are coupled on the yoke 210 with an air gap from the center magnet 220, and a center top plate 240 and a side top plate 250, which aid in forming a magnetic field, are attached on the center magnet 220 and the side magnets 230, respectively. The yoke 210, the center magnet 220, the side magnets 230, the center top plate 240 and the side top plate 250 compose a magnetic circuit that forms a magnetic field and that corresponds to a stationary part of the actuator. Although one embodiment of the present invention presents a 5 magnet type magnetic circuit composed of one center magnet 220 and four side magnets 230, the magnetic circuit may have any number of magnets, such as 1 magnet type, 2 magnet type, and 3 magnet type, so far as they can vibrate a voice coil 300 through a mutual electromagnetic force.

The voice coil 300 is disposed in the air gap between the center magnet 220 and the side magnets 230 to be able to vibrate vertically, with its upper end attached to a spring 400. The outer periphery of the spring 400 is attached on the frame 100, and a contact pad 500 is mounted at the center of the spring 400. The contact pad 500 is brought into contact with a panel, a frame or a bracket of a device to directly apply vibration to the device to generate sound.

Figure 4:
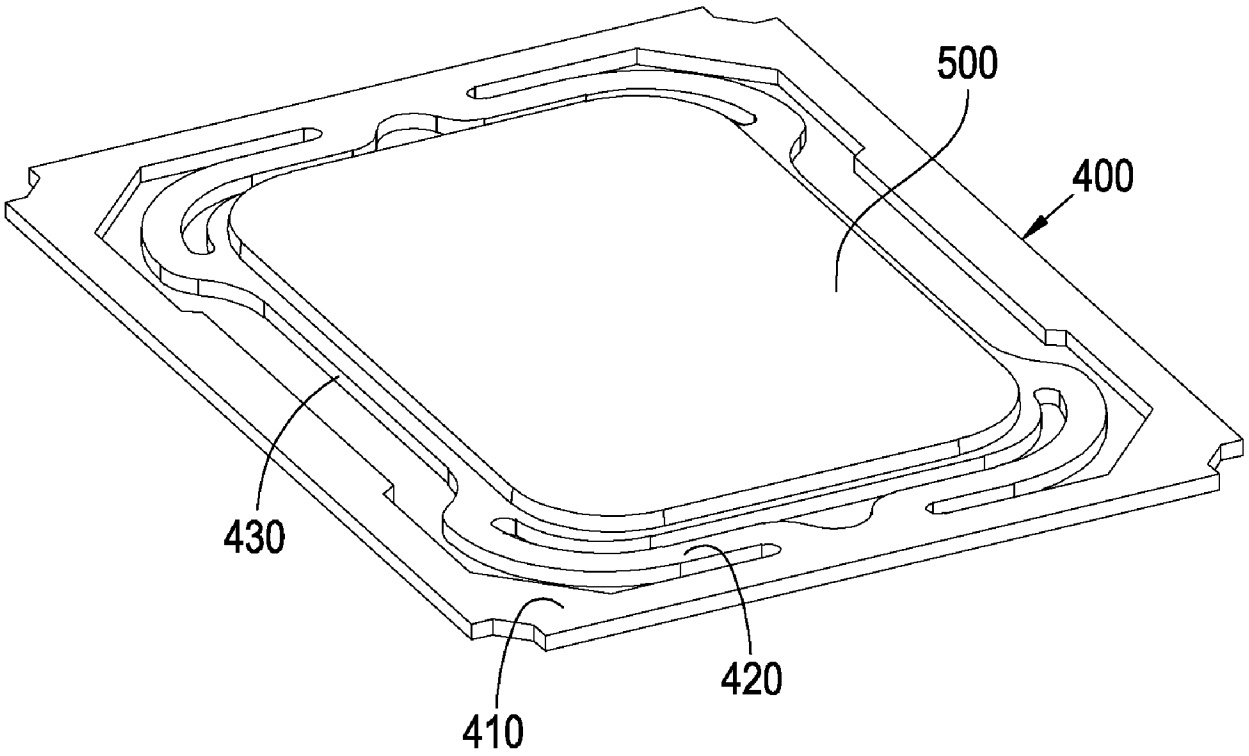
FIG. 4 is a view showing a spring and a contact pad coupled to each other, that are provided in the sound generating actuator according to the first embodiment of the present invention.

FIG. 4 is a view showing the spring and the contact pad coupled to each other, that are provided in the sound generating actuator according to the first embodiment of the present invention.

The spring 400 provided in the sound generating actuator according to the first embodiment of the present invention includes a rectangular ring-shaped outer peripheral portion 410 seated on the frame 100 (see FIG. 2), a center portion 430 formed at the center of the outer peripheral portion 410 at a distance from the outer peripheral portion 410, and bridges 420 elastically connecting the center portion 430 and the outer peripheral portion 410 in such a manner that the center portion 430 can vibrate relative to the outer peripheral portion 410. Referring to FIGS. 3 and 4, the center portion 430 of the spring 400 is perforated and the contact pad 500 is fitted into the perforated center portion 430.

Figure 5:
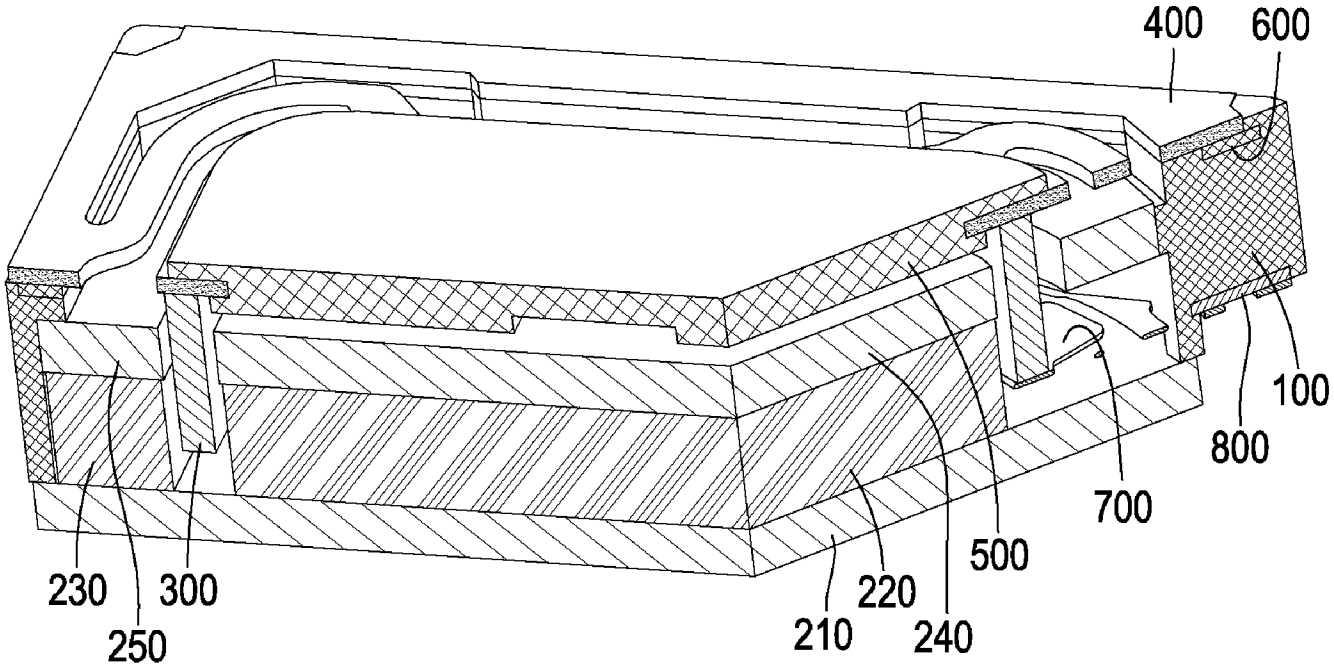
FIG. 5 is a sectional view showing a conductive member mounted in the sound generating actuator according to the first embodiment of the present invention.
Figure 6:
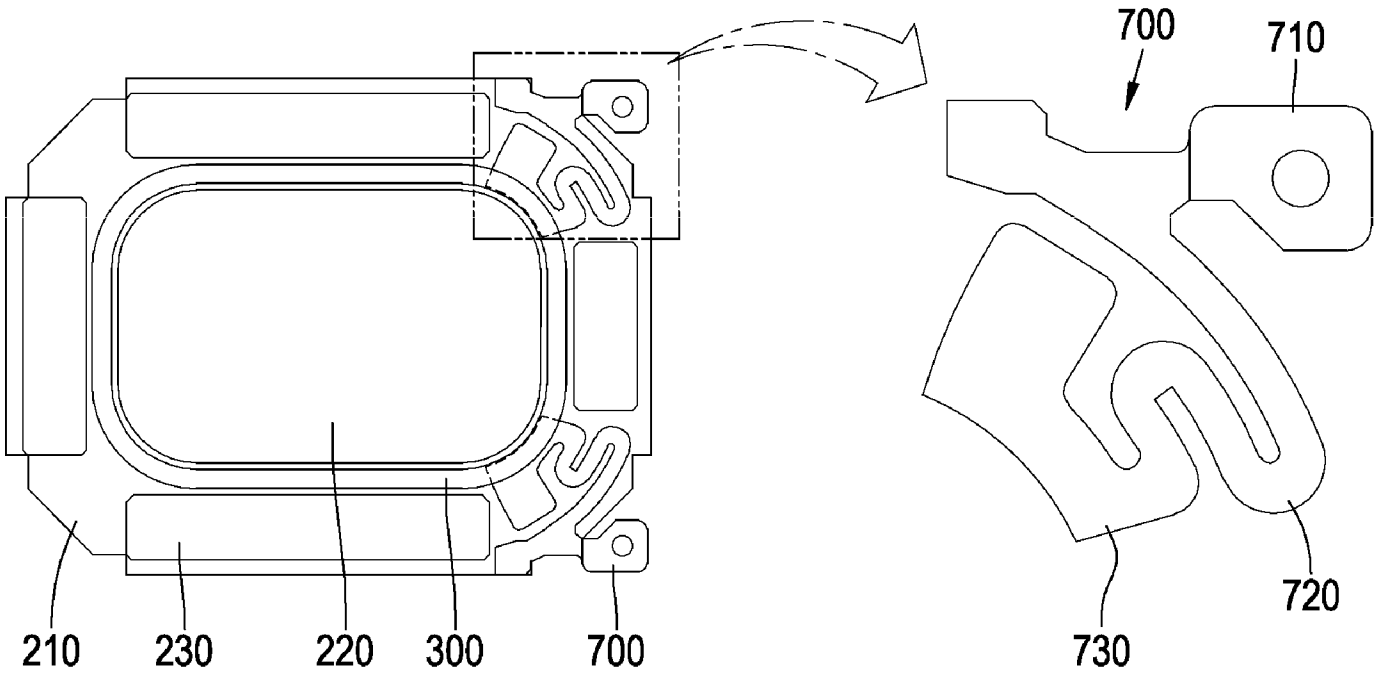
FIG. 6 is a view showing the conductive member provided in the sound generating actuator according to the first embodiment of the present invention.

FIG. 5 is a sectional view showing a conductive member mounted in the sound generating actuator according to the first embodiment of the present invention and FIG. 6 is a view showing the conductive member provided in the sound generating actuator according to the first embodiment of the present invention.

In the sound generating actuator according to the first embodiment of the present invention, the conductive member 700 is attached to a lower end of the voice coil 300 to transfer an electrical signal to the voice coil 300. One end of the conductive member 700 is attached to the lower end of the voice coil 300, while the other end thereof is extended to the outside of the frame 100. A land portion 710, which can be conductively connected with a terminal 800 formed on the frame 100, is formed on that portion exposed to the outside of the frame 100. A bent portion 720 with a few bendings is provided between an attachment end 730, which is attached to the lower end of the voice coil 300, and the land portion 710, not to interfere with the vertical vibration of the voice coil 300.

Figure 7:
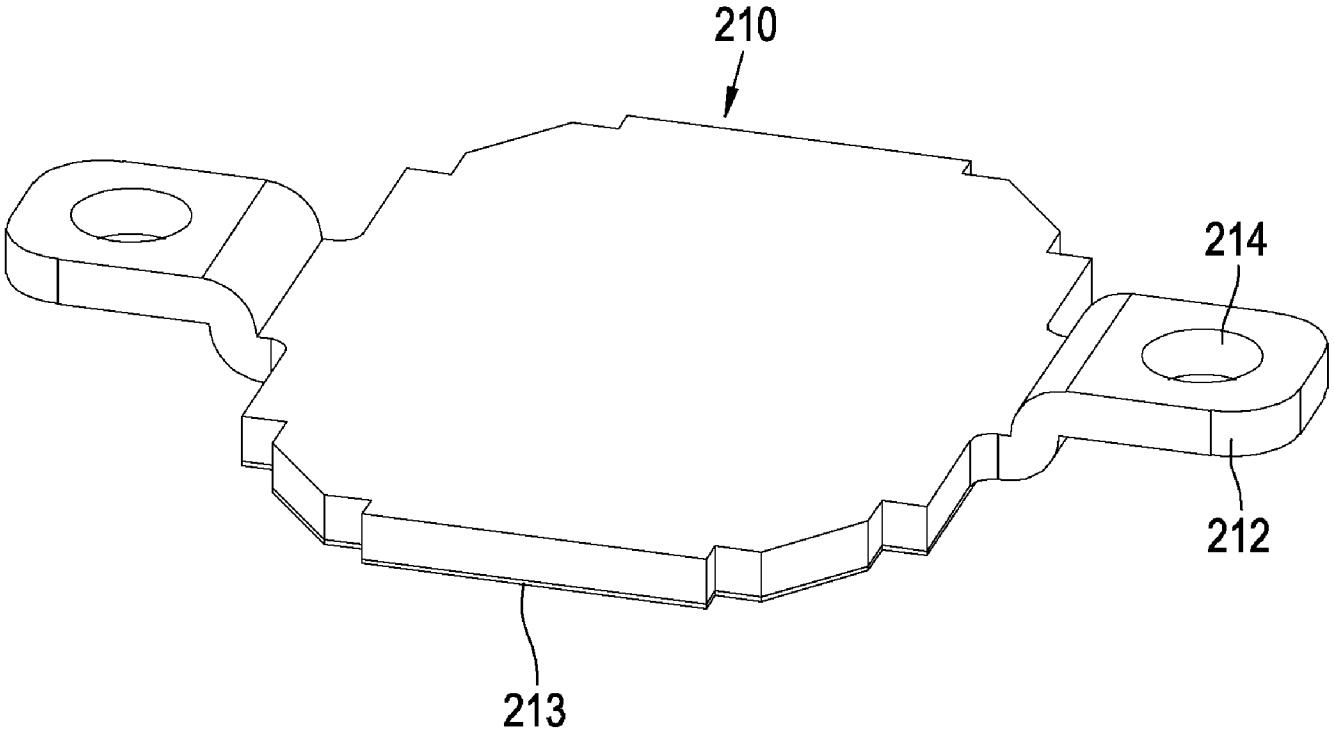
FIG. 7 is a view showing a yoke provided in the sound generating actuator according to the first embodiment of the present invention.

FIG. 7 is a view showing the yoke provided in the sound generating actuator according to the first embodiment of the present invention.

The yoke 210 is coupled to the bottom of the frame 100, with protruding portions 212 extended to protrude to the outside of the coupled surface. The protruding portions 212 are curved to surround the outer surface of the frame 100 and then extended in an outward direction of the frame 100. The protruding portions 212 have a fastening hole 214 to which a fastening member can be coupled, so that the sound generating actuator can be fastened to a device in need of vibration through the protruding portions 212. A heat dissipation material 213 may be attached on the bottom of the yoke 210 to aid in dissipating heat.

Figure 8:
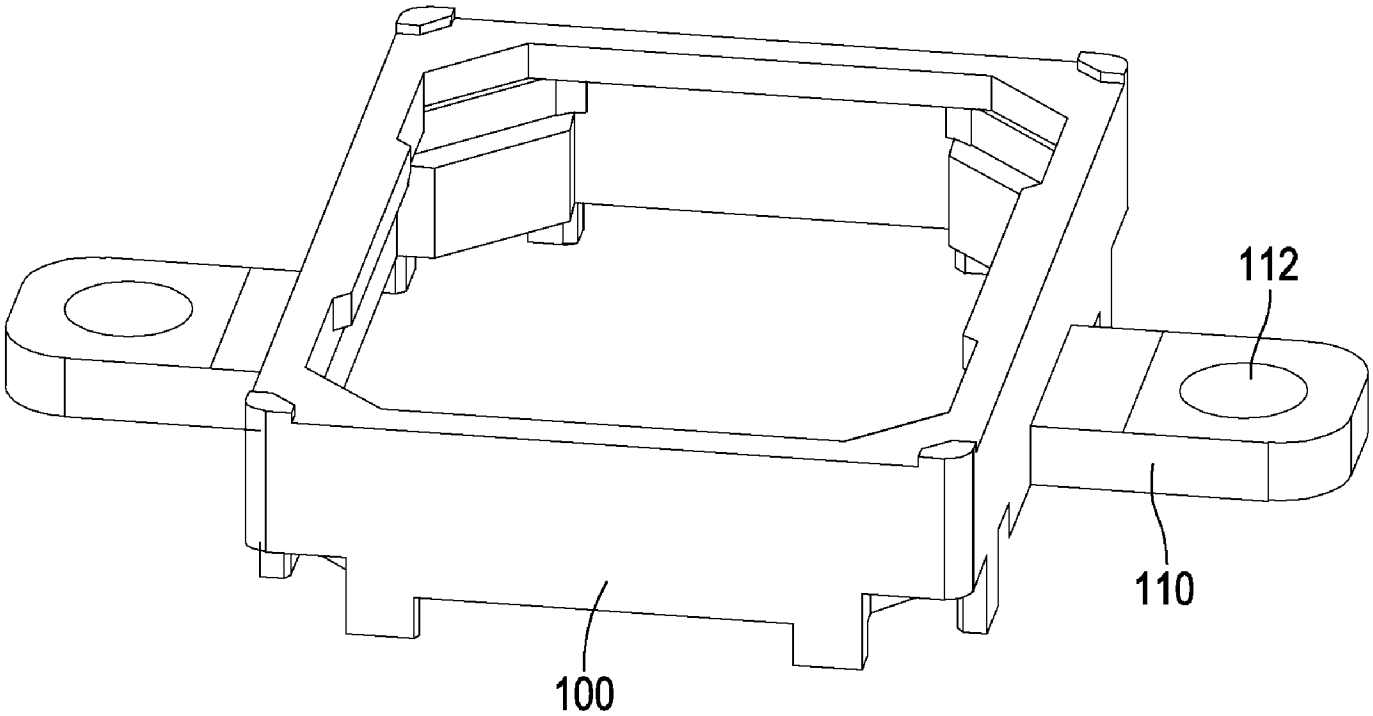
FIG. 8 is a view showing a yoke and a frame coupled to each other, that are provided in a sound generating actuator according to a second embodiment of the present invention.

FIG. 8 is a view showing a yoke and a frame coupled to each other, that are provided in a sound generating actuator according to a second embodiment of the present invention.

Extended portions 110 are extended to protrude from the side of the frame 100 to the outside. Fastening holes 112 to which fastening members can be coupled are provided in the extended portions 110, so that the sound generating actuator can be fastened to a device in need of vibration through the extended portions 110.

If need be, the extended portions 110 may be formed in any desired position at lower, middle or upper ends of the side of the frame 100.

Figure 9:
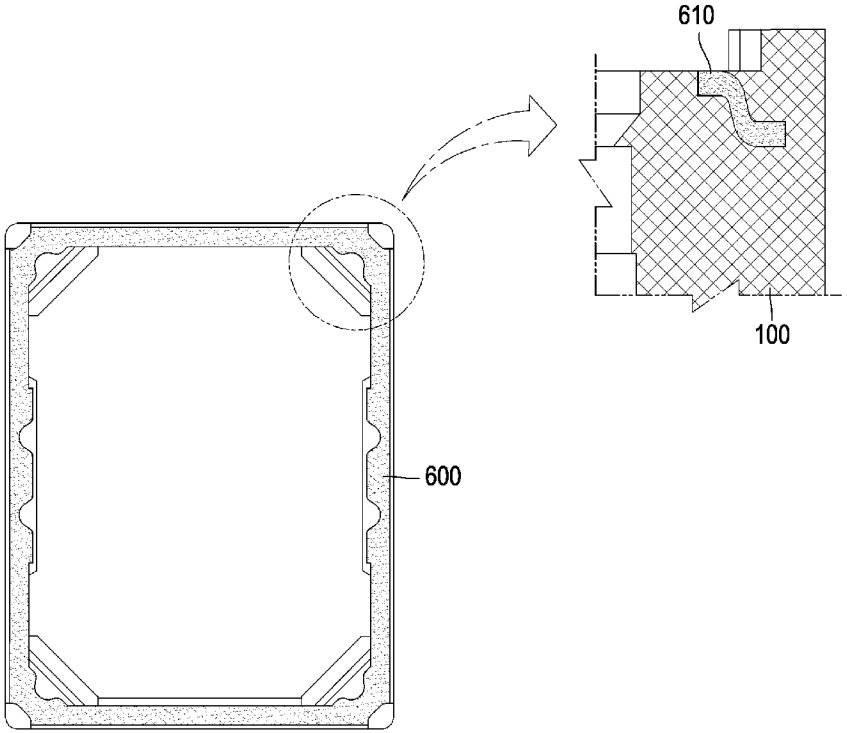
FIG. 9 is a view showing a frame and a ring plate coupled to each other, that are provided in the sound generating actuator according to the first embodiment of the present invention.
Figure 10:
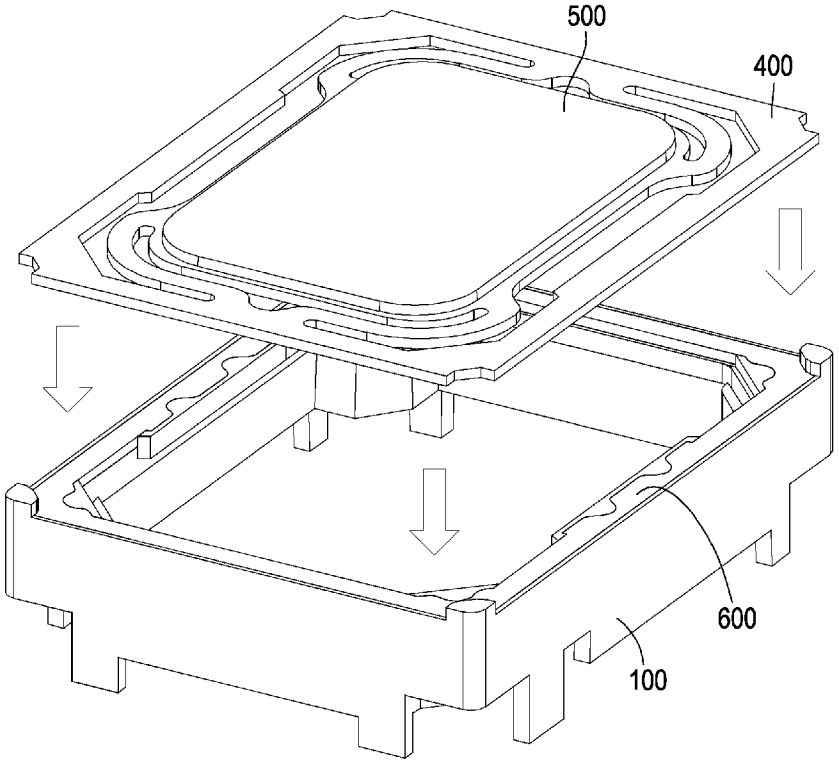
FIG. 10 is a view showing a frame and a spring coupled to each other, that are provided in the sound generating actuator according to the first embodiment of the present invention.

FIG. 9 is a view showing the frame and a ring plate coupled to each other, that are provided in the sound generating actuator according to the first embodiment of the present invention and FIG. 10 is a view showing the frame and the spring coupled to each other, that are provided in the sound generating actuator according to the first embodiment of the present invention.

In the sound generating actuator according to the first embodiment of the present invention, the ring plate 600 made of a metallic material is coupled to the surface of the frame 100 that comes in contact with the spring 400, i.e., to the top of the frame 100. Here, the corners 610 of the ring plate 600 are downwardly bent and insert injection molded into the frame 100. In addition, the spring 400 is also made of a metallic material, so may be coupled by welding.

Figure 11:
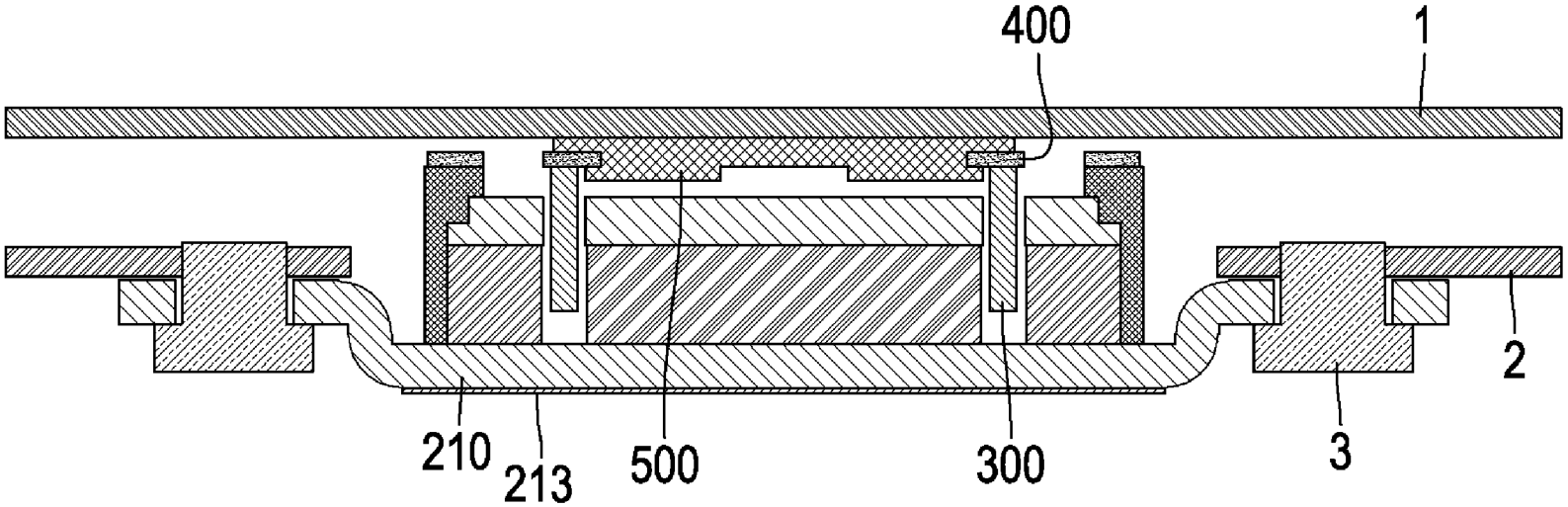
FIG. 11 is a view showing a sound generating actuator according to one embodiment of the present invention that is mounted in a multimedia device.

FIG. 11 is a view showing a sound generating actuator according to one embodiment of the present invention that is mounted in a multimedia device. As described above, fastening members 3 are inserted and coupled into the fastening holes 212 (see FIG. 8) formed in the protruding portions 212 of the yoke 210 and fastening holes formed in a frame 2 of a device in which the sound generating actuator will be mounted. Further, a panel 1 of the device and the contact pad 500 can be adhered to each other using an adhesive member.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A sound generating actuator, comprising:

a frame;

a stationary part mounted on the frame and provided with a yoke, a magnet and a top plate to compose a magnetic circuit;

a voice coil configured to receive an electrical signal and vibrate due to mutual electromagnetic force with a magnetic field of the stationary part;

a metal spring configured to dampen vibration of the voice coil, wherein the metal spring includes an outer peripheral portion secured to the frame, a center portion formed at a center of the outer peripheral portion at a distance from the outer peripheral portion, and bridges elastically connecting the center portion and the outer peripheral portion such that the center portion can vibrate relative to the outer peripheral portion, and wherein the voice coil is attached to a lower end of the center portion of the metal spring; and a contact pad attached to the center portion of the metal spring and configured to transfer vibration of the voice coil.

2. The sound generating actuator of claim 1, wherein the contact pad is insert injection molded at the center portion of the metal spring.

3. The sound generating actuator of claim 1, further comprising a conductive member having one end attached to the bottom of the voice coil and another end extended to outside of the frame.

4. The sound generating actuator of claim 3, wherein the conductive member comprises a plurality of bendings that do not to interfere with movement of the voice coil.

5. The sound generating actuator of claim 1, wherein the yoke comprises a protruding portion extended to protrude to an outer surface of the frame.

6. The sound generating actuator of claim 5, wherein the protruding portion comprises a fastening hole to which a fastening member can be coupled.

7. The sound generating actuator of claim 1, further comprising a metal ring plate insert injection molded on a surface of the frame that comes in contact with the metal spring.

8. The sound generating actuator of claim 7, wherein corners of the metal ring plate are downwardly bent.

9. The sound generating actuator of claim 1, further comprising a heat dissipation material attached on a bottom of the yoke and configured to aid in dissipating heat.

10. The sound generating actuator of claim 1, wherein the frame comprises a protruding portion extended to protrude to outside of the frame.

* * * * *